US010751792B2

(12) United States Patent
Zhang et al.

(10) Patent No.: US 10,751,792 B2
(45) Date of Patent: Aug. 25, 2020

(54) CONTINUOUS PRECISION FORMING DEVICE AND PROCESS FOR AMORPHOUS ALLOY

(71) Applicant: DONGGUAN EONTEC CO., LTD., Dongguan (CN)

(72) Inventors: Haifeng Zhang, Dongguan (CN); Huameng Fu, Dongguan (CN); Aimin Wang, Dongguan (CN); Zhengwang Zhu, Dongguan (CN); Hong Li, Dongguan (CN); Hongwei Zhang, Dongguan (CN); Yeung Tak Lugee Li, Hongkong (HK); Weirong Li, Dongguan (CN)

(73) Assignee: DONGGUAN EONTEC CO., LTD., Dongguan (CN)

( * ) Notice: Subject to any disclaimer, the term of this patent is extended or adjusted under 35 U.S.C. 154(b) by 0 days.

(21) Appl. No.: 16/342,681

(22) PCT Filed: Oct. 31, 2017

(86) PCT No.: PCT/CN2017/108549
§ 371 (c)(1),
(2) Date: Apr. 17, 2019

(87) PCT Pub. No.: WO2018/090820
PCT Pub. Date: May 24, 2018

(65) Prior Publication Data

US 2020/0047245 A1 Feb. 13, 2020

(30) Foreign Application Priority Data

Nov. 18, 2016 (CN) ..... 2016 1 1015560

(51) Int. Cl.
*B22D 18/06* (2006.01)
*C22C 1/00* (2006.01)

(52) U.S. Cl.
CPC ..... *B22D 18/06* (2013.01); *C22C 1/002* (2013.01)

(58) Field of Classification Search
CPC ..... B22D 25/06; B22D 18/06
See application file for complete search history.

(56) References Cited

U.S. PATENT DOCUMENTS

2015/0107304 A1* 4/2015 Beringov ..... B22D 27/02 65/33.2

* cited by examiner

*Primary Examiner* — Kevin P Kerns
*Assistant Examiner* — Steven S Ha
(74) *Attorney, Agent, or Firm* — Shimokaji IP

(57) ABSTRACT

A continuous precision forming device and process for an amorphous alloy is provided. By means of the device, when a melting platform with an alloy melt is rotated from the melting position to a position just below the forming mould (9), temperature of the alloy melt can be in the range of the overcooled liquid zone temperature of the alloy melt, and then a loading rod (7) drives the forming mould (9) to proceed with pressing forming. According to the process, press-forming is carried out in a certain temperature interval in the amorphous alloy melt solidification process, and the heating, cooling, solidification and forming in the forming process are coordinated, such that continuous forming of the amorphous alloy is achieved.

11 Claims, 1 Drawing Sheet

CONTINUOUS PRECISION FORMING DEVICE AND PROCESS FOR AMORPHOUS ALLOY

FIELD OF THE INVENTION

The present invention relates to technical field of amorphous alloy, and more particularly to a continuous precision forming device and process for amorphous alloy.

BACKGROUND OF THE INVENTION

Due to unique structural characteristic, amorphous alloys and amorphous alloy composite materials have excellent properties, which are not found in many crystalline materials, such as high specific strength, high wear resistance, high corrosion resistance, and unique deformation characteristics. It has broad application prospects in the fields of aerospace materials, national defense industry, and consumer electronics. There are two main preparation techniques for amorphous alloys and their composite materials. The first preparation method is directly to solidify liquid metal into amorphous alloy. For example, vacuum die casting technology is preformed by filling alloy melt into a cavity under a certain pressure, and then cooling the alloy melt, that is, mold filling is preformed at a liquidus temperature. In this way, parts with a complicated structure can be obtained, and the method is fast, efficient, and has good formability. However, some holes are formed on product surface, whose distribution and size are irregular, and pores are also generated within the product. In addition, it is difficult to achieve high vacuum conditions in this method, and obtain high quality products. The second preparation method is a forming technique in overcooled liquid zone temperature. Amorphous alloy is heated between a glass transition temperature ($T_g$) and an initial crystallization temperature ($T_x$) to form at a certain pressure and a certain speed, that is, the amorphous alloy is deformed and formed in a narrow temperature range. Specifically, firstly amorphous base metal is obtained, thus the preparation process is complicated, the efficiency is low, and it is difficult to control temperature and deformation time. Otherwise the product is prone to crystallization, and performance is deteriorated, and the product is useless.

Two preparation methods are combined in this application to process in the overcooled liquid zone temperature during a solidification process of alloy melt, thereby obtaining a high quality product and realizing a low cost and high efficiency preparation method.

SUMMARY OF THE INVENTION

One objective of the present invention is to provide a continuous precision forming device and process for amorphous alloy. The continuous precision forming device and process also apply to amorphous composite material. In this process, amorphous alloy or amorphous composite material melt is continuously formed under low-pressure using a special device when the amorphous alloy or amorphous composite material melt is cooled and in a range of the overcooled liquid zone temperature, and the process is shorten, has high production efficiency, saves cost, and can produce good product.

To achieve the above-mentioned objective, a continuous precision forming device for amorphous alloy is provided, which includes a vacuum chamber, an alloy smelting system, a feeding device, a forming system, and a work head.

Specifically, the vacuum chamber is selectively to be vacuumized or filled with a shielding gas. The feeding device is arranged for supplying the alloy raw material to the alloy smelting system. The alloy smelting system includes a heating device for melting alloy raw material into alloy melt and a plurality of melting platforms for receiving the alloy melt.

Specifically, the forming system includes a loading rod and a forming mould disposed at a lower end of the loading rod. The work head is mounted at a bottom of the vacuum chamber and provides a rotating rod at a center position of a bottom of the work head. Furthermore, the rotating rod is driven to rotate thereby driving the work head to rotate, and the melting platforms are disposed at an upper surface of the work head.

Furthermore, distances between the rotating rod and each melting platform are equal, and distances between two adjacent melting platforms are equal. The melting platform carrying the alloy melt is driven by the rotating rod to rotate from a melting position to a position under the forming mould, at this time, temperature of the alloy melt is in a range of overcooled liquid zone temperature, and the forming mould is driven by the loading rod to proceed with press forming.

Specifically, the heating device is an induction coil or an arc heating device. When the induction coil is applied, a smelting crucible is disposed below the feeding device, the induction coil is disposed outside the smelting crucible to heat the smelting crucible, and one of the melting platforms is rotated to a position under the smelting crucible. When an arc heating device is applied, the alloy raw material in the feeding device is placed in one of the melting platforms by a robot, and the arc heating device is located right above the melting platform with the alloy raw material.

Preferably, the smelting crucible is a quartz crucible, a ceramic crucible, or a water-cooled copper crucible. A baffle is arranged at a bottom of the smelting crucible. After the alloy raw material is melted, the baffle is removed so that the alloy melt in the smelting crucible flows onto the melting platform located under the smelting crucible.

Specifically, after press forming, amorphous alloy is taken out from the vacuum chamber by a sampling device.

Preferably, a plurality of the melting platforms are made of material which does not chemically react with the alloy raw material and does not affect heating, melting, solidification and forming process of the alloy raw material.

A continuous precision forming process by using the continuous precision forming device for amorphous alloy above-mentioned. When an induction coil is arranged to heat the alloy raw material, and the process includes:

vacuumizing the vacuum chamber;

loading the alloy raw material to the feeding device and then supplying the alloy raw material to a smelting crucible;

heating the alloy raw material to form the alloy melt which flows onto the melting platform located under the smelting crucible after a baffle disposed at a bottom of the smelting crucible is opened;

rotating the melting platform carrying the alloy melt from a melting position to a position under the forming mould; and performing press forming to the alloy melt by using the forming mould, and simultaneously cooling the alloy melt rapidly when the alloy melt is in the range of the overcooled liquid zone temperature between a glass transition temperature and a liquidus temperature, and finally obtaining an amorphous alloy.

Alternatively, when an arc heating device is arranged to heat the alloy raw material, and the process includes:

vacuumizing the vacuum chamber;

loading the alloy raw material to the feeding device and then supplying the alloy raw material to the melting platform located under the arc heating device;

heating the alloy raw material to form the alloy melt;

rotating the melting platform carrying the alloy melt from a melting position to a position under the forming mould; and performing press forming to the alloy melt by using the forming mould, and simultaneously cooling the alloy melt rapidly when the alloy melt being in a range of the overcooled liquid zone temperature between a glass transition temperature and a liquidus temperature; and finally obtaining an amorphous alloy.

Preferably, the vacuum chamber is vacuumized until a vacuum degree reaches $1\times10^{-1}$-$1\times10^{-4}$ Pa. The alloy raw material is prepared by smelting or casting; shape of the alloy raw material is a rod shape, a plate shape, a sheet shape and/or a spherical shape. Specifically, the alloy raw material is selected according to the amorphous alloy to be prepared.

Preferably, a cooling rate is $10^{-2}$-$10^{2}$ K/min when the alloy melt is cooled rapidly. The alloy melt is rapidly cooled by using the forming mould or a melting platform with a cooling function thereby obtaining the amorphous alloy.

Preferably, the heating and forming are carried out simultaneously in this process. According to time for heating and melting to set up movement speed of the melting platform to receive the alloy melt and the forming mould, continuous feeding, melting and forming are realized thereby achieving continuous forming of the amorphous alloy.

In comparison with the prior art, the present invention has the following advantages:

1. In this application, after the alloy raw material is melt, amorphous alloy melt is continuously formed under low-pressure when the amorphous alloy melt is cooled and in a range of the overcooled liquid zone temperature between a glass transition temperature and a liquidus temperature. A specific device is used in this process, because of smooth free surface, good deformation characteristics and low solidification shrinkage coefficient of the alloy melt, which is formed in the forming temperature range, the obtained amorphous alloy has high dimensional accuracy, good surface smoothness, dense internal components, and no shrinkage holes and other defects.

2. Continuous feeding, melting and forming are achieved in this process which is automatic and can realize industrial production.

3. The process is shorten, has high production efficiency, saves cost, and can produce good product.

4. The forming method in the present invention is adapted for preparing amorphous alloy components, such as: Zr-based amorphous alloy, Ti-based amorphous alloy, Fe-based amorphous alloy, Ni-based amorphous alloy, Al-based amorphous alloy, Mg Amorphous alloy, Pd-based amorphous alloy, Ag-based amorphous alloy, Au-based amorphous alloy, Hf-based amorphous alloy, Ca-based amorphous alloy, Pt-based amorphous alloy, Cu-based amorphous alloy, Co-based amorphous alloy and rare earth element based amorphous alloys. It can also be applied to amorphous composite material.

BRIEF DESCRIPTION OF THE DRAWINGS

The accompanying drawings facilitate an understanding of the various embodiments of this invention. In such drawings.

DETAILED DESCRIPTION OF ILLUSTRATED EMBODIMENTS

A distinct and full description of the technical solution of the present invention will follow by combining with the accompanying drawings.

Figure 1A:
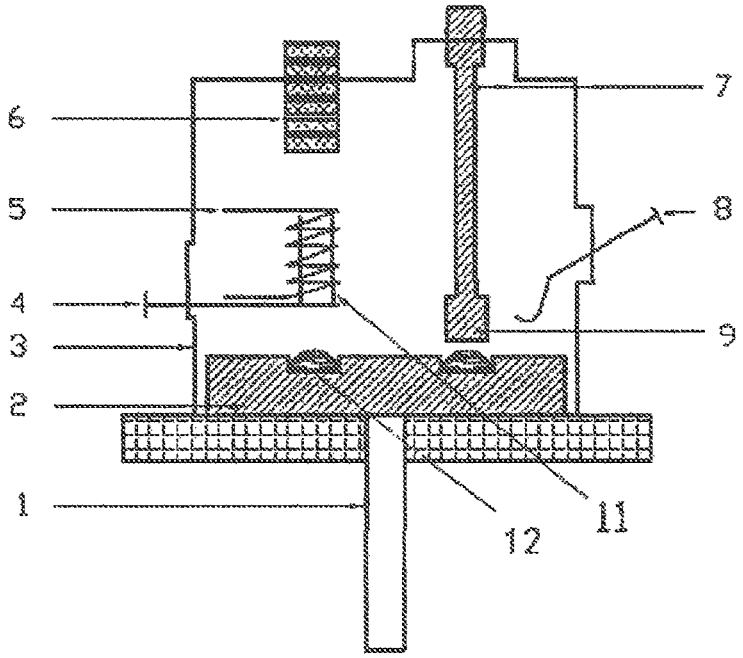
FIG. 1*a* is a perspective view of a continuous precision forming device for amorphous alloy where an induction coil is applied according to one embodiment of the present invention.
Figure 1B:
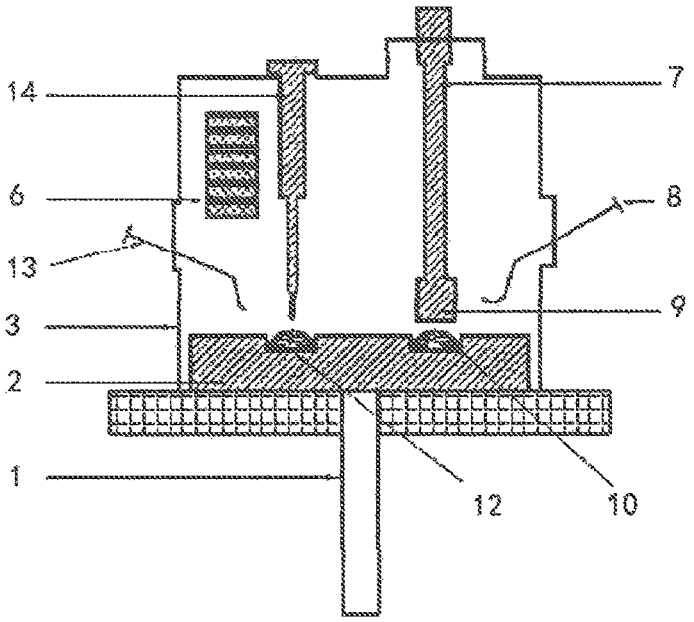
FIG. 1*b* is a perspective view of a continuous precision forming device for amorphous alloy where an arc heating device is applied according to one embodiment of the present invention.

Referring to FIGS. 1*a* and 1*b*, a continuous precision forming device for amorphous alloy includes a vacuum chamber 3, a feeding device 6, an alloy smelting system, a forming system, and a work head 2. Specifically, the vacuum chamber 3 is selectively to be vacuumized or filled with a shielding gas, and the feeding device 6 is arranged for supplying the alloy raw material to the alloy smelting system. Furthermore, the alloy smelting system includes a heating device for melting alloy raw material into alloy melt 12 and a plurality of melting platforms for receiving the alloy melt 12. Specifically, the forming system includes a loading rod 7 and a forming mould 9 disposed at a lower end of the loading rod 7. The work head 2 is mounted at a bottom of the vacuum chamber 3 and provides a rotating rod 1 at a center position of a bottom of the work head 2. Furthermore, the rotating rod 1 is driven to rotate thereby driving the work head 2 to rotate, and the melting platforms are disposed at an upper surface of the work head 2. More specifically, distances between the rotating rod 1 and each melting platform are equal, and distances between two adjacent melting platforms are equal. In this way, the melting platform carrying the alloy melt 12 is driven by the rotating rod 1 to rotate from a melting position to a position under the forming mould 9, at this time, and the forming mould 9 is driven by the loading rod 7 to proceed with press forming, thereby obtaining an amorphous alloy 10.

Specifically, the heating device is an induction coil or an arc heating device. When the induction coil is applied, a smelting crucible 11 is disposed below the feeding device 6, the induction coil 5 is disposed outside the smelting crucible 11 to heat the alloy raw material in the smelting crucible 11, and one of the melting platforms is rotated to a position under the smelting crucible 11. After the alloy raw material is melted, a baffle 4 at a bottom of the smelting crucible 11 is removed so that the alloy melt flows onto the melting platform located under the smelting crucible 11. When an arc heating device is applied, the alloy raw material in the feeding device 6 is placed in one of the melting platforms by a robot 13, and the arc heating device is located right above the melting platform with the alloy raw material.

Specifically, the melting platforms are not only used for carrying the alloy melt, but used for performing press forming by cooperating with the forming mould 9. The melting platforms are driven to rotate by the rotating rod 1 thereby feeding and forming continuously. After press forming is performed, the amorphous alloy is taken out from the vacuum chamber by a sampling device 8.

Preferably, a plurality of the melting platforms are made of material which does not chemically react with the alloy raw material and does not affect heating, melting, solidification and forming process of the alloy raw material.

When the induction coil is arranged to heat the alloy raw material, and the process includes:

vacuumizing the vacuum chamber;

loading the alloy raw material to the feeding device and then supplying the alloy raw material to a smelting crucible;

heating the alloy raw material to form the alloy melt which flows onto the melting platform located under the smelting crucible after a baffle disposed at a bottom of the smelting crucible is opened;

rotating the melting platform carrying the alloy melt from a melting position to a position under the forming mould; and performing press forming to the alloy melt by using the forming mould, and simultaneously cooling the alloy melt rapidly when the alloy melt is in the range of the overcooled liquid zone temperature between a glass transition temperature and a liquidus temperature, and finally obtaining an amorphous alloy.

Alternatively, when an arc heating device is arranged to heat the alloy raw material, and the process includes:

vacuumizing the vacuum chamber;

loading the alloy raw material to the feeding device and then supplying the alloy raw material to the melting platform located under the arc heating device;

heating the alloy raw material to form the alloy melt;

rotating the melting platform carrying the alloy melt from a melting position to a position under the forming mould; and performing press forming to the alloy melt by using the forming mould, and simultaneously cooling the alloy melt rapidly when the alloy melt is in a range of the overcooled liquid zone temperature between a glass transition temperature and a liquidus temperature; and finally obtaining an amorphous alloy.

It can be understood, the heating and forming are carried out simultaneously. According to time for heating and melting to set up movement speed of the melting platform to receive the alloy melt and the forming mould, continuous feeding, melting and forming are realized thereby achieving continuous forming of the amorphous alloy.

Specifically, the alloy raw material is prepared by smelting or casting; and the shape of the alloy raw material is a rod shape, a plate shape, a sheet shape and/or a spherical shape.

Furthermore, the alloy raw material is heated by arc heating, induction heating, resistance heating, laser heating, plasma heating, infrared heating or microwave heating.

The alloy melt is rapidly cooled by a low temperature forming mould or a melting platform having a cooling function thereby obtaining an amorphous alloy.

Embodiment 1

As shown in FIG. 1(*a*), the feeding device 6 is provided for continuous feeding. Firstly, the vacuum chamber 3 is vacuumized until the vacuum degree reaches $1\times10^{-1}$-$1\times10^{-4}$ Pa, and the alloy raw material is fed into the smelting crucible 11 in the induction coil 5. Then the alloy raw material is heated and melted by the induction coil 5 under the vacuum condition (or by argon shielding) to obtain the alloy melt 12, and then the heating is turned off. Subsequently, the rotating rod 1 rotates thereby driving the work head 2 to a position under the forming mould 9, and the alloy melt 12 is freely cooled. When the temperature of the alloy melt 12 is in a range of the overcooled liquid zone temperature between the glass transition temperature ($T_g$) and the liquidus temperature ($T_l$), the press forming is performed by the forming mold 9 on a lower end of the loading rod 7, and simultaneously the alloy melt is cooled rapidly. Specifically, the cooling rate is $10^{-2}$-$10^{2}$ K/min. Finally, the amorphous alloy 10 is obtained and taken out by the sampling device 8. In the above process, while the alloy melt 12 is rotated under the forming mould 9, another melting platform on the work head is also rotated to a position under the melting crucible, so the above-described melting-rotation-forming process is repeated at this position.

Embodiment 2

As shown in FIG. 1(*b*), the feeding device 6 is provided for continuous feeding. Firstly, the vacuum chamber 3 is vacuumized until the vacuum degree reaches $1\times10^{-1}$-$1\times10^{-4}$ Pa, and the alloy raw material is fed into the melting platform under the arc heating device (under an electrode 14). Then the alloy raw material is heated and melted by the electrode 14 to obtain the alloy melt 12, and then the heating is turned off. Subsequently, the rotating rod 1 rotates thereby driving the work head 2 to a position under the forming mould 9, and the alloy melt 12 is freely cooled. When the temperature of the alloy melt 12 is in a range of the overcooled liquid zone temperature between the glass transition temperature ($T_g$) and the liquidus temperature ($T_l$), the press forming is performed by the forming mold 9 on a lower end of the loading rod 7, and simultaneously the alloy melt is cooled rapidly. Specifically, the cooling rate is $10^{-2}$-$10^{2}$ K/min. Finally, the amorphous alloy 10 is obtained and taken out by the sampling device 8. In the above process, while the alloy melt 12 is rotated under the forming mould 9, another melting platform on the work head is also rotated to a position under the electrode 14, so the above-described melting-rotation-forming process is repeated at this position.

While the invention has been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention.

What is claimed is:

1. A continuous precision forming device for amorphous alloy, comprising a vacuum chamber, which is selectively to be vacuumized or filled with a shielding gas;

an alloy smelting system, comprising a heating device for melting alloy raw material into alloy melt and a plurality of melting platforms for receiving the alloy melt;

a feeding device, arranged for supplying the alloy raw material to the alloy smelting system;

a forming system, comprising a loading rod and a forming mould disposed at a lower end of the loading rod; and a work head, mounted at a bottom of the vacuum chamber and providing a rotating rod at a center position of a bottom of the work head, the rotating rod being driven to rotate thereby driving the work head to rotate, and the melting platforms being disposed at an upper surface of the work head;

wherein distances between the rotating rod and each melting platform are equal, and distances between two adjacent melting platforms are equal, the melting platform carrying the alloy melt is driven by the rotating rod to rotate from a melting position to a position under the forming mould, temperature of the alloy melt is in a range of overcooled liquid zone temperature, and the forming mould is driven by the loading rod to proceed with press forming.

2. The continuous precision forming device for amorphous alloy according to claim 1, wherein the heating device is an induction coil or an arc heating device; when the induction coil is applied, a smelting crucible is disposed below the feeding device, the induction coil is disposed outside the smelting crucible to heat the smelting crucible, and one of the melting platforms is rotated to a position under the smelting crucible.

3. The continuous precision forming device for amorphous alloy according to claim 1, when an arc heating device is applied, the alloy raw material in the feeding device is placed in one of the melting platforms by a robot, and the arc heating device is located right above the melting platform with the alloy raw material.

4. The continuous precision forming device for amorphous alloy according to claim 2, wherein the smelting crucible is a quartz crucible, a ceramic crucible, or a water-cooled copper crucible, a baffle is arranged at a bottom of the smelting crucible, after the alloy raw material is melted, the baffle is removed so that the alloy melt flows onto the melting platform located under the smelting crucible.

5. The continuous precision forming device for amorphous alloy according to claim 1, wherein amorphous alloy after press forming is taken out from the vacuum chamber.

6. The continuous precision forming device for amorphous alloy according to claim 1, wherein the plurality of melting platforms are made of material which does not chemically react with the alloy raw material and does not affect heating, melting, solidification and forming process of the alloy raw material.

7. A continuous precision forming process by using the continuous precision forming device for amorphous alloy according to claim 1, wherein an induction coil is arranged to heat the alloy raw material, and the process comprises:

vacuumizing the vacuum chamber;

loading the alloy raw material to the feeding device and then supplying the alloy raw material to a smelting crucible;

heating the alloy raw material to form the alloy melt which flows onto a melting platform located under the smelting crucible after a baffle disposed at a bottom of the smelting crucible is opened;

rotating the melting platform carrying the alloy melt from a melting position to a position under the forming mould; and performing press forming to the alloy melt by using the forming mould, and simultaneously cooling the alloy melt when the alloy melt is in the range of the overcooled liquid zone temperature between a glass transition temperature and a liquidus temperature, and finally obtaining an amorphous alloy.

8. The continuous precision forming process by using the continuous precision forming device for amorphous alloy according to claim 7, wherein the vacuum chamber is vacuumized until a vacuum degree reaches $1\times10^{-1}$-$1\times10^{-4}$ Pa, the alloy raw material is prepared by smelting or casting; shape of the alloy raw material is a rod shape, a plate shape, a sheet shape and/or a spherical shape; and the alloy raw material is selected according to the amorphous alloy to be prepared.

9. The continuous precision forming process by using the continuous precision forming device for amorphous alloy according to claim 7, wherein a cooling rate is $10^{-2}$-$10^{2}$ K/min when the alloy melt is cooled; and the alloy melt is cooled by using the forming mould or a melting platform with a cooling function thereby obtaining the amorphous alloy.

10. The continuous precision forming process by using the continuous precision forming device for amorphous alloy according to claim 7, wherein the heating and forming are carried out simultaneously; according to time for heating and melting to set up movement speed of the melting platform to receive the alloy melt and the forming mould, continuous feeding, melting and forming are realized thereby achieving continuous forming of the amorphous alloy.

11. A continuous precision forming process by using the continuous precision forming device for amorphous alloy according to claim 1, wherein an induction coil is arranged to heat the alloy raw material, and the process comprises:

vacuumizing the vacuum chamber;

loading the alloy raw material to the feeding device and then supplying the alloy raw material to a melting platform located under the arc heating device;

heating the alloy raw material to form the alloy melt;

rotating the melting platform carrying the alloy melt from a melting position to a position under the forming mould; and performing press forming to the alloy melt by using the forming mould, and simultaneously cooling the alloy melt when the alloy melt is in the range of the overcooled liquid zone temperature between a glass transition temperature and a liquidus temperature; and finally obtaining an amorphous alloy.

* * * * *